US005804363A

United States Patent [19]

Maskasky et al.

[11] Patent Number: 5,804,363

[45] Date of Patent: Sep. 8, 1998

[54] HIGH BROMIDE (111) TABULAR GRAIN EMULSIONS CONTAINING A CATIONIC PEPTIZER HAVING DIALLYLAMMONIUM DERIVED REPEATING UNITS

[75] Inventors: Joe E. Maskasky; Victor P. Scaccia, both of Rochester, N.Y.

[73] Assignee: Eastman Kodak Company, Rochester, N.Y.

[21] Appl. No.: 858,162

[22] Filed: Apr. 28, 1997

[51] Int. Cl.[6] ..... G03C 1/04; G03C 1/053; G03C 1/035

[52] U.S. Cl. ..... 430/567; 430/627

[58] Field of Search ..... 430/567, 569, 430/627

[56] References Cited

U.S. PATENT DOCUMENTS

| | | | |
|---|---|---|---|
| 3,288,770 | 11/1966 | Butler | 526/204 |
| 3,425,836 | 2/1969 | Perry et al. | 430/629 |
| 3,461,163 | 8/1969 | Boothe | 564/296 |
| 3,472,740 | 10/1969 | Boothe | 203/37 |
| 3,579,347 | 5/1971 | Wood | 430/628 |
| 3,749,577 | 7/1973 | Hollister et al. | 430/630 |
| 4,334,013 | 6/1982 | Bergthaller et al. | 430/569 |
| 4,350,759 | 9/1982 | Fitzgerald et al | 430/630 |
| 4,400,463 | 8/1983 | Maskasky | 430/434 |
| 4,434,226 | 2/1984 | Wilgus et al. | 430/567 |
| 4,464,523 | 8/1984 | Neigel et al. | 527/300 |
| 4,713,320 | 12/1987 | Maskasky | 430/567 |
| 4,713,323 | 12/1987 | Maskasky | 430/569 |
| 4,737,156 | 4/1988 | Tambor et al. | 8/490 |
| 5,380,642 | 1/1995 | Roberts et al. | 430/569 |
| 5,385,819 | 1/1995 | Bowman et al. | 430/569 |
| 5,478,715 | 12/1995 | Ohzeki et al. | 430/567 |
| 5,604,085 | 2/1997 | Maskasky | 430/567 |

OTHER PUBLICATIONS

*Research Disclosure,* vol. 389, Sep. 1996, Item 38957, II.A.

Mees *The Theory of the Photographic Process,* Revised Ed., Macmillan, 1951, pp. 48 & 49.

James, *The Theory of the Photographic Process,* 4th Ed., Macmillan, 1977, p. 51.

*Primary Examiner*—Mark F. Huff

*Attorney, Agent, or Firm*—Carl O. Thomas

[57] ABSTRACT

A radiation-sensitive high bromide {111 } tabular grain emulsion is disclosed containing a dispersing medium including a peptizer adsorbed to the tabular grains. The peptizer is a polymeric hydrophilic colloid containing repeating units derived from a diallylammonium monomer.

10 Claims, No Drawings

HIGH BROMIDE (111) TABULAR GRAIN EMULSIONS CONTAINING A CATIONIC PEPTIZER HAVING DIALLYLAMMONIUM DERIVED REPEATING UNITS

FIELD OF THE INVENTION

The invention is directed to photographic emulsions. More specifically, the invention is directed to high bromide tabular grain emulsions containing selected peptizers.

DEFINITION OF TERMS

In referring to grains and emulsions containing two or more halides, the halides are named in order of ascending concentrations.

In referring to grains and emulsions the mole percentage of halide is based on total silver.

The term "gelatino-peptizer" refers to gelatin and gelatin derivative silver halide grain peptizers.

The term "equivalent circular diameter" or "ECD" is employed to indicate the diameter of a circle having the same projected area as a silver halide grain.

The term "aspect ratio" designates the ratio of grain ECD to grain thickness (t).

The term "tabularity" is defined as $ECD/t^2$, where ECD and t are both measured in micrometers ($\mu$m).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "high bromide" or "high chloride" in referring to grains and emulsions indicates that bromide or chloride, respectively, are present in concentrations of greater than 50 mole percent, based on total silver.

The term "{111} tabular" is employed in referring to tabular grains and tabular grain emulsions in which the tabular grains have {111} major faces.

The term "thin" in referring to tabular grains and tabular grain emulsions indicates a mean tabular grain thickness of less than 0.2 $\mu$m.

BACKGROUND

Photographic emulsions are comprised of a dispersing medium and silver halide microcrystals, commonly referred to as grains. As the grains are precipitated from an aqueous medium, a peptizer, usually a hydrophilic colloid, is adsorbed to the grain surfaces to prevent the grains from agglomerating. Subsequently binder is added to the emulsion and, after coating, the emulsion is dried. The peptizer and binder are collectively referred to as the photographic vehicle of an emulsion.

Gelatin and gelatin derivatives form both the peptizer and the major portion of the remainder of the vehicle in the overwhelming majority of silver halide photographic elements. An appreciation of gelatin is provided by this description contained in Mees *The Theory of the Photographic Process,* Revised Ed., Macmillan, 1951, pp. 48 and 49:

> Gelatin is pre-eminently a substance with a history; its properties and its future behavior are intimately connected with its past. Gelatin is closely akin to glue. At the dawn of the Christian era, Pliny wrote, "Glue is cooked from the hides of bulls." It is described equally shortly by a present-day writer as "the dried down soup or consommé of certain animal refuse." The process of glue making is age-old and consists essentially in boiling down hide clippings or bones of cattle and pigs. The filtered soup is allowed to cool and set to a jelly which, when cut and dried on nets, yields sheets of glue or gelatin, according to the selection of stock and the process of manufacture. In the preparation of glue, extraction is continued until the ultimate yield is obtained from the material; in the case of gelatin, however, the extraction is halted earlier and is carried out at lower temperatures, so that certain strongly adhesive but nonjelling constituents of glue are not present in gelatin. Glue is thus distinguished by its adhesive properties; gelatin by its cohesive properties, which favor the formation of strong jellies.

> Photographic gelatin is generally made from selected clippings of calf hide and ears as well as cheek pieces and pates. Pigskin is used for the preparation of some gelatin, and larger quantities are made from bone. The actual substance in the skin furnishing the gelatin is collagen. It forms about 35 per cent of the coria of fresh cattle hide. The corresponding tissue obtained from bone is termed ossein. The raw materials are selected not only for good structural quality but for freedom from bacterial decomposition. In preparation for the extraction, the dirt with loose flesh and blood is eliminated in a preliminary wash. The hair, fat, and much of the albuminous materials are removed by soaking the stock in limewater containing suspended lime. The free lime continues to rejuvenate the solution and keeps the bath at suitable alkalinity. This operation is followed by deliming with dilute acid, washing, and cooking to extract the gelatin. Several "cooks" are made at increasing temperatures, and usually the products of the last extractions are not employed for photographic gelatin. The crude gelatin solution is filtered, concentrated if necessary, cooled until it sets, cut up, and dried in slices. The residue, after extraction of the gelatin, consists chiefly of elastin and reticulin with some keratin and albumin.

> Gelatin may also be made by an acid treatment of the stock without the use of lime. The stock is treated with dilute acid (pH 4.0) for one to two months and then washed thoroughly, and the gelatin is extracted. This gelatin differs in properties from gelatin made by treatment with lime.

In addition to the collagen and ossein sought to be extracted in the preparation of gelatin there are, of course, other materials entrained. For example, James *The Theory of the Photographic Process,* 4th Ed., Macmillan, 1977, p. 51, states:

> Although collagen generally is the preponderant protein constituent in its tissue of origin, it is always associated with various "ground substances" such as noncollagen protein, mucopolysaccharides, polynucleic acid, and lipids. Their more or less complete removal is desirable in the preparation of photographic gelatin.

Superimposed on the complexity of composition is the variability of composition, attributable to the varied diets of the animals providing the starting materials. The most notorious example of this was provided by the forced suspension of manufacturing by the Eastman Dry Plate Company in 1882, ultimately attributed to a reduction in the sulfur content in a purchased batch of gelatin.

Considering the time, effort, complexity and expense involved in gelatin preparation, it is not surprising that research efforts have in the past been mounted to replace the gelatin used in photographic emulsions and other film layers.

The problem of replacing gelatin as a vehicle lies in the fact that it is capable of performing the quite different functions of each of the adsorbed peptizer, needed to keep silver halide emulsion grains from agglomerating, and the binder, which is necessary to produce a coating with structural integrity. A few materials have been demonstrated to be capable of acting as peptizer substitutes for gelatin. A much wider range of materials have been demonstrated to be capable of acting as vehicles, although the unique "chill setting" characteristics of gelatin render the latter practically more advantageous in coating processes that most of the substitute binders.

*Research Disclosure,* Vol. 389, September 1996, Item 38957, II. Vehicles, vehicle extenders, vehicle-like addenda and vehicle related addenda, A. Gelatin and hydrophilic colloid peptizers, lists a variety of materials that have been investigated for use either as peptizers, binders or both in photographic elements containing silver halide emulsion layers. *Research Disclosure* is published by Kenneth Mason Publications, Ltd., Dudley House, 12 North St., Emsworth, Hampshire P010 7DQ, England.

During the 1980's a marked advance took place in silver halide photography based on the discovery that a wide range of photographic advantages, such as improved speed-granularity relationships, increased covering power, both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of selected high (>50 mole %) bromide tabular grain populations in photographic emulsions.

Since initial investigations of the tabular grain emulsions were undertaken employing gelatin and gelatin derivative peptizers, it was initially assumed that the same vehicles previously used for precipitating and coating silver halide emulsions would also be useful for tabular grain emulsions. For example, Wilgus et al U.S. Pat. No. 4,434,226, directed to high bromide {111} tabular grain emulsions and their precipitation, contains an earlier version of the listing of photographic vehicles contained in *Research Disclosure* 38957, cited above.

Subsequent investigations of new peptizers have found that there is no reliable basis for predicting how a particular new peptizer will influence the precipitation of tabular grain emulsions. Some modifications of peptizers enhance tabular grain characteristics while others can actually result in failure to obtain tabular grain shapes. The following illustrate this point:

Perry et al U.S. Pat. No. 3,425,836 describes the precipitation of emulsions in the presence of an acrylate copolymer containing repeating units derived from a quaternary ammonium monomer. In some instances tabular grains were observed in the emulsions.

Hollister et al U.S. Pat. No. 3,749,577 reports the precipitation of emulsions in the presence of a peptizer comprising a polymer having both quaternary ammonium moiety, the polymer being comprised of polymerized vinyl imidazolium compounds, polymerized vinyl pyridinium compounds, and polymerized vinyl compounds having a specific formula pendant ammonium group. Hollister et al contains no mention of tabular grains in the emulsions prepared.

Maskasky U.S. Pat. No. 4,400,463 disclosed the use of synthetic peptizers in combination with adenine to produce high (>50 mole %) chloride tabular grain emulsions where gelatin is demonstrated to fail as a tabular grain peptizer.

Maskasky U.S. Pat. Nos. 4,713,320 and 4,713,323 demonstrated that high bromide and high chloride tabular grain emulsions could be improved by treating gelatin with an oxidizing agent.

Maskasky U.S. Pat. No. 5,604,085 demonstrated that high bromide {111} tabular grain emulsions can be precipitated employing a cationic starch as a peptizer. However, tabular grain emulsions were not realized when anionic or non-ionic starch was substituted as a peptizer.

Roberts et al U.S. Pat. No. 5,380,642 and Bowman et al U.S. Pat. No. 5,385,819 demonstrate that employing polymers containing ammmonium pendant groups in some instances produced tabular grains and in some instances failed to produce tabular grains.

Wood U.S. Pat. No. 3,579,347 demonstrates silver iodobromide emulsions containing as a vehicle added after grain precipitation (i.e., not employed as a peptizer) a water soluble homopolymer containing repeating units derived from N,N-diallylamonium monomer. Wood provides no description of the physical characteristics of the grains.

SUMMARY OF THE INVENTION

This invention has as one of its purposes to provide high bromide {111} tabular grain emulsions that substitute a novel and more advantageous peptizer for the gelatino-peptizers conventionally employed in the preparation of this class of emulsions. Specifically, the peptizer substituted can be prepared more conveniently and with better control than gelatin and gelatin derived peptizers.

The high bromide {111} tabular grain emulsions of the invention contain tabular grains that fall within highly desirable grain parameters. Specifically, the emulsions of the invention are highly desirable "thin" tabular grain emulsions, and the tabular grains account for high proportion of the total projected are of grains that are concurrently precipitated.

In one aspect this invention is directed to a radiation-sensitive emulsion comprised of silver halide grains including tabular grains (a) having {111} major faces, (b) containing greater than 50 mole percent bromide, based on silver, (c) accounting for greater than 70 percent of total grain projected area, and (d) exhibiting a mean thickness of less than 0.2 $\mu$m, and a dispersing medium including a peptizer adsorbed to the silver halide grains, wherein the peptizer is a polymeric hydrophilic colloid containing repeating units derived from a diallylammonium monomer accounting for at least 10 percent by weight of the total weight of the hydrophilic colloid.

PREFERRED EMBODIMENTS

The radiation-sensitive emulsions of the invention are high bromide {111} tabular grain emulsions. The emulsions contain tabular grains (a) having {111} major faces, (b) containing greater than 50 mole percent bromide, based on silver, (c) accounting for greater than 70 percent of total grain projected area, and (d) exhibiting a mean thickness of less than 0.2 $\mu$m. The grain characteristics of the emulsions of the invention place them in a class with the most desirable conventional high bromide {111} tabular grain emulsions.

The feature that distinguishes the emulsions of the invention from conventional emulsions is the peptizer adsorbed to the surface grain surfaces. The peptizer is a polymeric hydrophilic colloid containing repeating units derived from a diallylammonium monomer accounting for at least 20 percent by weight of the total weight of the hydrophilic colloid.

A variety of polymers have been generated by polymerizing diallylammonium salts. It is generally agreed that in converting from a monomer to a polymeric repeating unit the carbon-to-carbon double bonds in the allyl groups provide the reaction sites to produce a cyclic structure that forms the repeating units. However, the published literature in some instances shows a six membered ring and in other instances shows a five membered ring to result from the polymerization reaction. For example, Butler et al U.S. Pat. No. 3,288,770 and Wood U.S. Pat. No. 3,579,347 assign six membered ring structures to the polymer repeating units. J. E. Lancaster, L. Baccei and H. P. Panzer, *J. Polym. Sci. Polym. Lett. Ed.,* 14, 549 (1976), reports careful investigations resulting in the conclusion that the polymer repeating units are in fact five membered rings, as illustrated by the following:

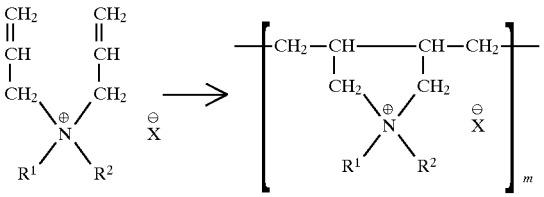

(I)

It is immaterial to the practice of the invention whether a five or six membered ring is assigned to repeating units of the polymer. Hence, the invention is not intended to be limited to any particular theoretical explanation of the reaction structure produced.

The diallylammonium salt employed as a monomer can take any convenient conventional form. Descriptions of diallylammonium salts useful as starting materials in preparing the peptizers of the invention are provided by Butler et al U.S. Pat. No. 3,288,770, Wood U.S. Pat. No. 3,579,347 and Tambor et al U.S. Pat. No. 4,737,156, the disclosures of which are here incorporated by reference.

Referring to formula I above, in a preferred form of the diallylammonium salt $R^1$ and $R^2$ can be independently selected from among hydrogen, phenyl and alkyl of from 1 to 16 carbon atoms, optimally from 1 to 3 carbon atoms.

The sole function of the anion $X^-$ is to provide charge neutrality. Thus $X^-$ can be selected from among the various anions conventionally present during the precipitation of radiation-sensitive high bromide emulsions. For example, chloride, bromide, nitrate, hydroxide and carboxylate (e.g., acetate) anions are all well suited to be associated with the peptizer during emulsion precipitation. It is, of course, recognized that the anions associated with the diallylammonium salt during polymerization can be easily replaced with anions preferred to be present during grain precipitation. Thus, a still broader choice of anions are available for the monomers used for polymerization.

In its simplest possible form the peptizer is a homopolymer of the diallylammonium salt. When a homopolymer is produced, m in formula I is determined solely by the intended molecular weight of the polymer.

In an alternate form, diallylammonium salt can be reacted with any convenient conventional vinyl monomer to produce a copolymer. Thus, the overall copolymer can take the form:

$$[—A_a—B_b—]_m \quad \text{(II)}$$

where

A represents the repeating units derived from diallylammonium salt;

a represents the weight fraction of A repeating units—at least 0.10;

B represents the repeating units derived from one or more comonomers;

b represents the weight fraction of B repeating units—up to 0.90;

a and b together equal 1.0; and m is chosen to provide the desired molecular weight.

For copolymers, b is preferably at least 0.05. When the polymer is a homopolymer, b is zero and a is 1.0.

Since many simple vinyl monomers, such as vinyl hydrocarbon monomers, produce hydrophobic homopolymers, it is, of course, necessary to limit the proportion of such comonomers so that the resulting polymer retains hydrophilic characteristics.

Preferably comonomers are selected that either (1) produce hydrophilic homopolymers or (2) contain polar or ionic groups that are capable of contributing to overall hydrophilic characteristics. Typical desirable comonomers include vinyl alcohol, acrylic and methacrylic acid, acrylamide and methacrylamide, mono- or di-N-substituted acrylamide and methacrylamide, vinyl pyrrolidone, sodium or ammmonium styrene sulfonate, and alkyl or hydroxyalkyl acrylates and methacrylates. Comonomers of this type are disclosed to be useful in preparing the diallylammonium salt containing copolymers by Neigel et al U.S. Pat. No. 4,464,523, the disclosure of which is here incorporated by reference. A more extensive listing of homopolymers capable of functioning as synthetic peptizers is provided by Ohzeki et al U.S. Pat. No. 5,478,715, the disclosure of which is here incorporated by reference. The monomers of these homopolymers can be employed as comonomers in the diallylammonium salt containing copolymers employed as peptizers.

As an alternative to the copolymers of formula II, it is specifically contemplated to employ graft copolymers containing repeating units derived from diallylammonium salt as a grafted moiety. These polymer structures can be appreciated by reference to the following:

$$G_g—P \quad \text{(III)}$$

where

G is a grafted linear polymer moiety;

g is an integer of at least 1; and

P is the host polymer.

The grafted linear polymer moiety can consist of a homopolymer of diallylammonium salt. In this form G can be represented by the repeating unit shown in formula I, where g and m are chosen to provide the weight fraction of the total polymer accounted for by the grafted linear polymer moiety. Alternatively, the grafted linear polymer moiety can itself be a copolymer of the type illustrated by formula II, where m and a are chosen to provide the A repeating units in the desired weight fraction of the total polymer. It is immaterial whether the grafted linear polymer moiety is linked to P through the A or B repeating units.

Since the host polymer P typically forms a major (>50% by weight, based on total weight) of the overall polymer satisfying formula III, it is preferred to choose the host polymer from among known polymers that are capable of forming hydrophilic colloids absent graft substitution. Any hydrophilic polymer providing one or more reaction sites for grafting can be employed. Polysaccharides represent a specifically preferred class of host polymers, since their hydroxyl groups enhance their hydrophilic properties and provide ready sites for graft bonding, either directly or through linking groups. Tambor et al U.S. Pat. No. 4,737,156 and Iovine et al U.S. Pat. No. 4,803,071, the disclosures of which are here incorporated by reference, disclose graft copolymers satisfying formula III, wherein the host polymer (also referred to as a substrate) takes the form of a gum, such as galactomannom gum, or a cellulose, including cellulose derivatives, such as hydroxyalkyl (e.g., hydroxyethyl or hydroxypropyl), alkyl (e.g., methyl or ethyl), and carboxyalkyl (e.g., carboxymethyl) cellulose derivatives.

The integer g is typically small in relation to the number of repeating units making up the host polymer P. For example, Tambor et al indicates that typically a host cellulose polymer contains more than 500 anhydroglucose units for each grafted polymer chain. Thus, only a few reactive sites need be incorporated in the host polymer. g is at least 1 and is typically less than 20 and most typically less than 10.

The overall molecular weight of the peptizer containing repeating units derived from allylammonium salt can vary widely. Any molecular weight can be selected that produces a water dispersible hydrophilic colloid. Preferably the peptizer exhibits a molecular weight in the range of from $2\times10^4$ to $4\times10^6$, most preferably from $1\times10^5$ to $2\times10^6$.

The repeating units derived from allylammonium salt are contemplated to constitute at least 10 (preferably 15) percent, on a weight basis, of the total weight of the hydrophilic colloid polymer. When the polymer is a homopolymer, the repeating units derived from allylammonium salt account for the total weight of the polymer. Optimum proportions of the repeating units derived allylammmonium salt can be expected to vary as a function of the other components of the overall polymer.

The diallylammonium salt derived (DAD) repeating unit containing polymeric hydrophilic colloid peptizer (hereinafter referred to as the DAD peptizer) is present during the precipitation (during nucleation and grain growth or during grain growth) of the high bromide {111} tabular grains. Preferably precipitation is conducted by substituting the DAD peptizer a conventional gelatino-peptizer. In substituting the DAD peptizer for conventional gelatino-peptizer, the concentrations of the DAD peptizer and the point or points of addition can correspond to those employed using gelatino-peptizers.

In addition, it has been unexpectedly discovered that emulsion precipitation can tolerate even higher concentrations of the DAD peptizer. For example, it has been observed that all of the DAD peptizer required for the preparation of an emulsion through the step of chemical sensitization can be present in the reaction vessel prior to grain nucleation. This has the advantage that no peptizer additions need be interjected after tabular grain precipitation has commenced. It is generally preferred that from 1 to 500 grams (most preferably from 5 to 100 grams) of the DAD peptizer per mole of silver to be precipitated be present in the reaction vessel prior to tabular grain nucleation.

At the other extreme, it is, of course, well known, as illustrated by Mignot U.S. Pat. No. 4,334,012, here incorporated by reference, that no peptizer is required to be present during grain nucleation, so that, if desired, addition of the DAD peptizer can be deferred until grain growth has progressed to the point that peptizer is actually required to avoid tabular grain agglomeration.

The procedures for high bromide {111 } tabular grain emulsion preparation through the completion of tabular grain growth require only the substitution of the DAD peptizer for conventional gelatino-peptizers. The following high bromide {111} tabular grain emulsion precipitation procedures, here incorporated by reference, are specifically contemplated to be useful in the practice of the invention, subject to the DAD peptizer substitutions discussed above:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The high bromide {111} tabular grain emulsions that are formed preferably contain at least 70 mole percent bromide and optimally at least 90 mole percent bromide, based on silver. Silver bromide, silver iodobromide, silver chlorobromide, silver iodochlorobromide, and silver chloroiodobromide tabular grain emulsions are specifically contemplated. Although silver chloride and silver bromide form tabular grains in all proportions, chloride is preferably present in concentrations of 30 mole percent or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent. It is generally preferred that the iodide concentration be less than 20 mole percent and optimally less than 10 mole percent, each based on total silver. Significant photographic advantages can be realized with iodide concentrations as low as 0.5 mole percent, with an iodide concentration of at least 1 mole percent being preferred.

The high bromide {111} tabular grain emulsions can exhibit mean grain ECD's of any conventional value, ranging up to 10 μm, which is generally accepted as the maximum mean grain size compatible with photographic utility. In practice, the tabular grain emulsions of the invention typically exhibit a mean ECD in the range of from about 0.2 to 5.0 μm. The DAD peptizers are capable of producing thin tabular grains having mean thicknesses of less than 0.2 μm. As demonstrated in the Examples below much lower mean tabular grain thicknesses can be readily realized.

The advantages that tabular grains impart to emulsions generally increases as the average aspect ratio or tabularity of the tabular grain emulsions increases. Both aspect ratio (ECD/t) and tabularity ($ECD/t^2$) increase as average tabular grain thickness decreases. Therefore it is generally sought to minimize the thicknesses of the tabular grains to the extent possible for the photographic application. Absent specific application prohibitions, it is generally preferred that the tabular grains having a thickness of less than 0.2 μm and accounting for greater than 70 percent (optimally at least 90 percent) of total grain projected area exhibit an average aspect ratio of greater than 5 and most preferably greater than 8. Tabular grain average aspect ratios can range up to 100, 200 or higher, but are typically in the range of from about 12 to 80. Tabularities of >25 are generally preferred.

Conventional dopants can be incorporated into the tabular grains during their precipitation, as illustrated by the patents cited above and *Research Disclosure,* Item 38957, cited above, Section I. Emulsion grains and their preparation, D. Grain modifying conditions and adjustments, paragraphs (3), (4) and (5). It is specifically contemplated to incorporate shallow electron trapping site providing (SET) dopants in the tabular grains as disclosed in *Research Disclosure,* Vol. 367, November 1994, Item 36736.

It is also recognized that silver salts can be epitaxially grown onto the tabular grains during the precipitation process. Epitaxial deposition onto the edges and/or corners of tabular grains is specifically taught by Maskasky U.S. Pat. No. 4,435,501, cited above and here incorporated by reference. In a specifically preferred form high chloride silver halide epitaxy is present at the edges or, most preferably, restricted to corner adjacent sites on the tabular grains.

Although epitaxy onto the host tabular grains can itself act as a sensitizer, the emulsions of the invention show unexpected sensitivity enhancements with or without epitaxy when chemically sensitized in the absence of a gelatino-peptizer, employing one or a combination of noble metal, middle chalcogen and reduction chemical sensitization techniques. Conventional chemical sensitizations by these techniques are summarized in *Research Disclosure,* Item 38957, cited above, Section IV. Chemical sensitizations. All of these sensitizations, except those that specifically require the presence of gelatin (e.g., active gelatin sensitization) are applicable to the practice of the invention. It is preferred to employ at least one of noble metal (typically gold) and middle chalcogen (typically sulfur) and, most preferably, a combination of both in preparing the emulsions of the invention for photographic use.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the selected peptizers, since ion removal is inherently limited to removing much lower molecular weight solute ions.

Spectral sensitization of the emulsions of the invention is not required, but is highly preferred, even when photographic use of the emulsion is undertaken in a spectral region in which the tabular grains exhibit significant native sensitivity. While spectral sensitization is most commonly undertaken after chemical sensitization, spectral sensitizing dye can be advantageous introduced earlier, up to and including prior to grain nucleation. Kofron et al U.S. Pat. No. 4,439,520 discloses advantages for "dye in the finish" sensitizations, which are those that introduce the spectral sensitizing dye into the emulsion prior to the heating step (finish) that results in chemical sensitization. Maskasky U.S. Pat. No. 4,435,501 teaches the use of aggregating spectral sensitizing dyes, particularly green and red absorbing cyanine dyes, as site directors for epitaxial deposition. These dyes are present in the emulsion prior to the chemical sensitizing finishing step. When the spectral sensitizing dye present in the finish is not relied upon as a site director for the silver salt epitaxy, a much broader range of spectral sensitizing dyes is available. The spectral sensitizing dyes disclosed by Kofron et al, particularly the blue spectral sensitizing dyes shown by structure and their longer methine chain analogous that exhibit absorption maxima in the green and red portions of the spectrum, are particularly preferred for incorporation in the tabular grain emulsions of the invention. A more general summary of useful spectral sensitizing dyes is provided by *Research Disclosure,* Item 38957, cited above, Section V. Spectral sensitization and desensitization.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an emulsion according to the invention after chemical sensitization has been completed.

At any time following chemical sensitization and prior to coating additional vehicle is added to the emulsions of the invention. Conventional vehicles and related emulsion components are illustrated by *Research Disclosure,* Item 38957, cited above, Section II. Vehicles, vehicle extenders, vehicle-like addenda and vehicle related addenda.

Aside from the features described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure,* Item 38957, Section I. Emulsion grains and their preparation, E. Blends, layers and performance categories. Other common, but optional features are illustrated by *Research Disclosure,* Item 38957, Section VII, Antifoggants and stabilizers; Section VIII, Absorbing and scattering materials; Section IX, Coating physical property modifying agents; Section X, Dye image formers and modifiers. The features of Sections II and VII–X can alternatively be provided in other photographic element layers.

The photographic applications of the emulsions of the invention can encompass other conventional features, such as those illustrated by *Research Disclosure,* Item 38957, Sections:

XI. Layers and layer arrangements
XII. Features applicable only to color negative
XIII. Features applicable only to color positive
XIV. Scan facilitating features
XV. Supports
XVI. Exposure
XVII. Physical development systems
XVIII. Chemical development systems
XIX. Development
XX. Desilvering, washing, rinsing and stabilizing (post-development)

EXAMPLES

The invention can be better appreciated by reference to the following specific embodiments. Except as otherwise indicated all weight percentages (wt %) are based on total weight.

Example 1

AgIBr, 2.4 Mole % Iodide, Tabular Grain Emulsion Made Using a Diallyldimethylammonium Modified Cellulose Into a reaction vessel was added 400 g of an aqueous solution containing 2.7 mmoles of NaBr and 8 g of Celquat® L-200. (Celquat® L-200 is a hydroxyethyl cellulose grafted with diallyldimethylammonium chloride constituting 26 percent by weight of the total weight. This cationic cellulose derivative has 2.3 wt % nitrogen. It was obtained from National Starch and Chemical Company, Bridgewater, N.J.) To the vigorously stirred solution at 40° C. and pH 5.5 was added a 2M $AgNO_3$ solution at 10 mL per min for 0.2 min. Concurrently, a salt solution of 2.01M NaBr and 0.048M KI was added initially at 10 mL per min and then at a rate needed to maintain a pBr of 2.12. Then the additions were stopped, 5 mL of a 2M NaBr solution was added rapidly and the temperature of the contents of the reaction vessel was increased to 60° C. at a rate of 5° C. per 3 min. At 60° C., the $AgNO_3$ solution was added at 1.0 mL per min for 1 min, then its addition rate was accelerated to 4 mL per min in 90 min and then held at 4 mL per min until a total of 200 mL had been added. The salt solution was concurrently added at a rate needed to maintain a constant pBr of 1.44. The pH was maintained at 5.5.

The resulting tabular grain emulsion was comprised of tabular grains having an average equivalent circular diameter of 1.2 μm, an average thickness of 0.13 μm, and an average aspect ratio of 9. The tabular grain population made up 83% of the total projected area of the emulsion grains.

Example 2

This emulsion was prepared similarly to Example 1, except that the precipitation was stopped after 100 mL of the 2M $AgNO_3$ solution had been added.

The tabular grain population of the resulting emulsion consisted of tabular grains with an average equivalent circular diameter of 1.0 μm, an average thickness of 0.12 μm, and with an average aspect ratio of 8. The tabular grain population made up 87% of the total projected area of the emulsion grains.

Example 3

This emulsion was prepared similarly to Example 1, except that 8 g of Celquat® H100 was substituted for the Celquat® L-200. (Celquat® H100 is a hydroxyethyl cellulose grafted with diallyldimethylammonium chloride accounting for 12.7 percent by weight of the total weight. This cationic cellulose derivative has 1.1 wt % nitrogen. It was obtained from National Starch and Chemical Company, Bridgewater, N.J.)

The tabular grain population of the resulting emulsion consisted of tabular grains with an average equivalent circular diameter of 1.2 μm, an average thickness of 0.12 μm, and with an average aspect ratio of 10. The tabular grain population made up 75% of the total projected area of the emulsion grains.

Example 4

This emulsion was prepared similarly to Example 3, except that the precipitation was stopped after 100 mL of the 2M $AgNO_3$ solution had been added.

The tabular grain population of the resulting emulsion consisted of tabular grains with an average equivalent circular diameter of 1.2 μm, an average thickness of 0.09 μm, and with an average aspect ratio of 12. The tabular grain population made up 80% of the total projected area of the emulsion grains.

Control Example 5

AgIBr, 2.4 Mole % Iodide, Non-tabular Grain Emulsion Made Using a Trimethylammonium Cationic Modified Cellulose This emulsion was prepared similarly to Example 1, except that Celquat® SC230M was used instead of the Celquat® L-200. (Celquat® SC230M is a hydroxyethyl cellulose grafted with trimethylammonium substituted epoxide. This cationic cellulose derivative has 1.8 wt % nitrogen.)

The resulting emulsion consisted of cubo-octahedra having an average size of 0.50 μm. No tabular grains were observed.

Control Example 6

AgIBr, 2.4 Mole % Iodide, Non-tabular Grain Emulsion Made Using a Trimethylammonium Cationic Modified Cellulose This emulsion was prepared similarly to Example 1 except that Celquat® SC240C was used instead of the Celquat® L-200. (Celquat® SC240C is a hydroxyethyl cellulose grafted with trimethylammonium substituted epoxide. This cationic cellulose derivative has 1.7 wt % nitrogen.)

The resulting emulsion consisted of cubo-octahedra having an average size of 0.45 μm. No tabular grains were observed.

Example 7

AgIBr, 2.4 Mole % Iodide, Tabular Grain-Emulsion Made Using Poly(diallyldimethylammonium Chloride)-co-(acrylic Acid)

Into a reaction vessel was added 400 g of an aqueous solution containing 2.7 mmoles of NaBr and 30 g of a 27 wt % solution of FLOC AID® 19. (FLOC AID® 19 is a copolymer of 53 wt % diallyldimethylammonium chloride with acrylic acid. It contains 4.6 wt % nitrogen. It was obtained from Alco Chemical, Chattanooga, Tenn.) To the vigorously stirred solution at 40° C. and pH 5.5 was added a 2M $AgNO_3$ solution at 10 mL per min for 0.2 min. Concurrently, a salt solution of 2.01M NaBr and 0.048M KI was added initially at 10 mL per min and then at a rate needed to maintain a pBr of 2.12. Then the additions were stopped, 5 mL of a 2M NaBr solution was added rapidly and the temperature of the contents of the reaction vessel was increased to 60° C. at a rate of 5° C. per 3 min. At 60° C., the $AgNO_3$ solution was added at 1.0 mL per min for 1 min, then its addition rate was accelerated to 4 mL per min in 90 min and then held at 4 mL per min until a total of 200 mL had been added. The salt solution was concurrently added at a rate needed to maintain a constant pBr of 1.44. The pH was maintained at 5.5.

The resulting tabular grain emulsion was comprised of tabular grains having an average equivalent circular diameter of 2.2 μm, an average thickness of 0.11 μm, and an average aspect ratio of 20. The tabular grain population made up 85% of the total projected area of the emulsion grains.

Example 8

This emulsion was prepared similarly to Example 7, except that the precipitation was stopped after 100 mL of the 2M $AgNO_3$ solution had been added.

The tabular grain population of the resulting emulsion consisted of tabular grains with an average equivalent circular diameter of 1.5 μm, an average thickness of 0.09 μm, and with an average aspect ratio of 17. The tabular grain population made up 85% of the total projected area of the emulsion grains.

Example 9

AgIBr, 2.4 Mole % Iodide, Tabular Grain Emulsion Made Using Poly(diallyldimethylammonium Chloride)

This emulsion was prepared similarly to Example 7, except that 20 g of a 20 wt % solution of high molecular weight poly(diallyldimethylammonium chloride) was substituted for FLOC AID® 19. It was obtained from Aldrich Chemical Co., St. Louis, Mo.

The tabular grain population of the resulting emulsion consisted of tabular grains with an average equivalent circular diameter of 2.1 μm, an average thickness of 0.12 μm, and with an average aspect ratio of 18. The tabular grain population made up 90% of the total projected area of the emulsion grains.

Example 10

This emulsion was prepared similarly to Example 9, except that the precipitation was stopped after 100 mL of the 2M $AgNO_3$ solution had been added.

The tabular grain population of the resulting emulsion consisted of tabular grains with an average equivalent circular diameter of 1.8 μm, an average thickness of 0.11 μm, and with an average aspect ratio of 16. The tabular grain population made up 90% of the total projected area of the emulsion grains.

Control Example 11

AgIBr, 2.4 Mole % Iodide, Non-tabular Grain Emulsion Made Using Poly(2-methacryloxyethyltrimethylammonium Methylsulfonate)

This emulsion was prepared similarly to that of Example 7, except that an equivalent weight of poly(2-methacryloxyethyltrimethylammonium methylsulfonate) was substituted for the FLOC AID® 19.

The resulting emulsion consisted of non-tabular grains. A low-aspect-ratio tabular-like population made up 40% of the total projected area; these grains had an average equivalent circular diameter of 2.8 μm, an average thickness of 0.60 μm, and an average aspect ratio of 4.7. This was not a tabular grain emulsion.

Control Example 12

This emulsion was prepared similarly to Example 11, except that the precipitation was stopped after 100 mL of the 2M $AgNO_3$ solution had been added.

The resulting emulsion consisted of non-tabular grains. A low-aspect-ratio tabular-like population made up 40% of the total projected area; these grains had an average equivalent circular diameter of 2.0 μm, an average thickness of 0.38 μm, and an average aspect ratio of 5.3. This was not a tabular grain emulsion.

From a review of the Examples above it is apparent that precipitation in the presence of the DAD peptizers satisfying the requirements of the invention is capable of producing high bromide {111} tabular grain emulsions in which the tabular grains having mean thicknesses of less than 0.2 μm and the tabular grains account for greater than 70 percent of total grain projected area. On the other hand, various other peptizers having cationic repeating units are demonstrated to lack this capability. Based on the performance of the control Examples and other failures reported in the patents cited in the Background section of the specification, it is apparent that advantageous capabilities of the DAD peptizers were not predictable and have required actual precipitation observations to discover.

The invention has been described in detail with particular reference to preferred embodiments thereof, but it will be understood that variations and modifications can be effected within the spirit and scope of the invention.

What is claimed is:

1. A radiation-sensitive emulsion comprised of silver halide grains including tabular grains (a) having {111} major faces, (b) containing greater than 50 mole percent bromide, based on silver, (c) accounting for greater than 70 percent of total grain projected area, and (d) exhibiting a mean thickness of less than 0.2 μm, and a dispersing medium including a peptizer adsorbed to the silver halide grains, wherein the peptizer is a polymeric hydrophilic colloid containing repeating units derived from a diallylammonium monomer accounting for at least 10 percent by weight of the total weight of the hydrophilic colloid, said diallylammonium monomer satisfying the formula:

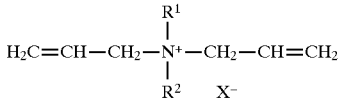

where $R^1$ and $R^2$ are chosen from alkyl and phenyl and $X^-$ is a charge balancing anion.

2. A radiation-sensitive emulsion according to claim 1 wherein the polymeric hydrophilic colloid containing repeating units are derived from said diallylammonium monomer accounts for at least 30 mole percent of the hydrophilic colloid.

3. A radiation-sensitive emulsion according to claim 1 wherein the polymeric hydrophilic colloid satisfies the formula:

$$[—A_a—B_b—]_m$$

where

A represents the repeating units derived from said diallylammonium monomer;

a represents the weight fraction of A repeating units and ranges from 0.1 to 1.0;

B represents the repeating units derived from one or more vinyl comonomers;

b represents the weight fraction of B repeating units and ranges from 0 to 0.9;

a and b together equal 1.0; and m is chosen to provide a molecular weight in the range of from $2\times10^4$ to $4\times10^6$.

4. A radiation-sensitive emulsion according to claim 3 wherein the polymeric hydrophilic colloid is a homopolymer.

5. A radiation-sensitive emulsion according to claim 3 wherein B represents repeating units derived from monomers of at least one of acrylic acid, methacrylic acid, acrylate esters, methacrylate esters, acrylamides, and methacrylamides.

6. A radiation-sensitive emulsion according to claim 1 wherein the polymeric hydrophilic colloid satisfies the formula:

$$G_g—P$$

where

G is a grafted linear polymer moiety containing repeating units derived from said diallylammonium monomer;

g is an integer of at least 1; and

P is a polysaccharide host polymer.

7. A radiation-sensitive emulsion according to claim 6 wherein the host polymer is derived from cellulose.

8. A radiation-sensitive emulsion according to 6 wherein the host polymer accounts for greater than 50 percent by weight of the peptizer, based on total weight.

9. A radiation-sensitive emulsion according to claim 1 wherein $R^1$ and $R^2$ are chosen from alkyl groups of from 1 to 3 carbon atoms.

10. A radiation-sensitive emulsion according to claim 9 wherein $R^1$ and $R^2$ are methyl.

* * * * *